US008613256B2

(12) United States Patent
Cardon

(10) Patent No.: US 8,613,256 B2
(45) Date of Patent: Dec. 24, 2013

(54) OVERBED TABLE TRASH BAG HOLDER AND SYSTEM

(71) Applicant: Stewart S. Cardon, Whitefish, MT (US)

(72) Inventor: Stewart S. Cardon, Whitefish, MT (US)

( * ) Notice: Subject to any disclaimer, the term of this patent is extended or adjusted under 35 U.S.C. 154(b) by 0 days.

(21) Appl. No.: 13/750,011

(22) Filed: Jan. 25, 2013

(65) Prior Publication Data

US 2013/0186308 A1 Jul. 25, 2013

Related U.S. Application Data

(60) Provisional application No. 61/590,443, filed on Jan. 25, 2012.

(51) Int. Cl.
*A47B 85/00* (2006.01)

(52) U.S. Cl.
USPC ..... 108/26; 108/152

(58) Field of Classification Search
USPC ..... 108/25, 26, 152
See application file for complete search history.

(56) References Cited

U.S. PATENT DOCUMENTS

| | | | | | |
|---|---|---|---|---|---|
| 484,718 | A * | 10/1892 | Isaacs | 108/26 |
| 1,678,375 | A * | 7/1928 | Berssenbrugge | 108/26 |
| 2,707,141 | A * | 4/1955 | Witter | 108/26 |
| 4,747,352 | A * | 5/1988 | Guidry et al. | 108/26 |
| 6,253,399 | B1 * | 7/2001 | Wagner | 108/49 |
| 6,283,042 | B1 * | 9/2001 | Wargo et al. | 108/26 |
| 6,347,581 | B2 * | 2/2002 | Sahli et al. | 108/26 |
| 6,484,989 | B1 * | 11/2002 | Connery | 108/26 |
| 6,802,263 | B1 * | 10/2004 | Kolb | 108/26 |
| 7,314,010 | B2 * | 1/2008 | George et al. | 108/50.01 |
| 8,245,650 | B1 * | 8/2012 | McKsymick | 108/26 |
| 2002/0043181 | A1 * | 4/2002 | Gist | 108/26 |
| 2006/0225624 | A1 * | 10/2006 | Grace | 108/26 |

* cited by examiner

*Primary Examiner* — Jose V Chen
(74) *Attorney, Agent, or Firm* — Dean A. Craine

(57) ABSTRACT

A disposable trash bag system that allows a patient to dispose personal trash when lying in a hospital bed thereby reducing contamination. The system includes a moveable overbed table, a bag holding member, an intermediate member disposed between the bag holding member and the table's perimeter side edge, and a ring element that receives a disposable trash bag. The ring element is connected to the intermediate member that temporarily snap fits against the perimeter side edge and over the table. During use, a disposable trash bag with an upper supportive ring member is placed in the ring element, the bag holding member and the intermediate member are connected together. The intermediate member is forced against the perimeter side edge at a desired location to hold the bag in place. The intermediate member may be easily moved to any location along the perimeter side edge and remove entirely for cleaning.

15 Claims, 6 Drawing Sheets

OVERBED TABLE TRASH BAG HOLDER AND SYSTEM

This utility patent application is based on and claims the filing date benefit of U.S. provisional patent application (Application No. 61/590,443), filed on Jan. 25, 2012.

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

The invention generally relates to infection control systems used in hospitals, skilled nursing facilities, and in nursing homes, and more particularly to disposable trash bag systems for contaminated trash generated by patients lying in a hospital bed.

2. Description of the Related Art

Patients lying in a hospital bed generate personal trash such as gum, facial tissues, napkins, and paper towels that must be properly discarded to prevent the spread of infections.

While most patients know that the trash they generate may be contaminated and should be properly discarded, the personal trash they generate is sometimes left on the overbed table, on the bedding, or dropped on the floor because a trash receptacle was not within easy reach of the patient when lying in the bed. Eventually, the trash is picked up by a healthcare worker or by a family member and deposits it into floor trash receptacle. Unexpectedly, the worker or family member may be contaminated with germs and viruses from the patient.

Overbed tables are commonly used in a hospital to serve food or beverages to a patient lying in a bed. Overbed tables are also used as support surfaces for temporarily holding books, magazines, or for writing or for playing cards. They typically include a rectangular table top mounted at one end to a height adjustable vertical column. The table top is a single, planar structure with a uniform thickness and made of hard, laminated plastic that can be thoroughly sanitized with a suitable disinfectant manually applied by housekeeping personnel. The lower end of the vertical column is mounted on a low profile base with caster wheels that allows the base to easily roll across the floor and, if desired, extend under the bed. During use, the overbed table may be moved to different positions around the bed to accommodate different positions of a patient lying on a hospital bed, and to accommodate different pieces of medical equipment that may be setup around the bed.

What is needed is a disposable trash bag holder system that holds a disposable trash bag at different locations around a patient lying in different locations on a hospital bed. Such a system should enable the disposable trash bag to be selective moved to accommodate the different positions of the patient in the bed. What is also needed is a system that supports a trash bag in partially open configuration so that trash can be easily deposited into the bag without manually manipulating the bag. What is also needed is a system that satisfies the above needs that does not interfere with commonly used housekeeping tasks employed to reduce bacterial and viral infections in the facility.

SUMMARY OF THE INVENTION

It is an object of the invention disclosed herein is to provide a disposable trash bag system that includes a holder designed to hold a disposable trash bag in a partially open configuration so that it may be easily filled with soiled tissues or objects by the patient laying at different positions and locations in a hospital bed.

It is another object to provide a disposable trash bag system that uses the table top of an overbed table that can be easily moved to different gross locations around patient and can be manually disinfected with a suitable agent.

It is another object to provide such a system that uses a bag holder can be selectively attached and removed from the table top and allows the disposable bag to be easily inserted and removed from the holder using minimal contact to the table top surface, the holder or the bag.

These and other objects of the invention are met by system for preventing the spread of infection in a healthcare facility where patients positioned on beds generate personal trash that may be contaminated. The system is designed to so the patient themselves may easily dispose of their trash directly into a disposable trash bag so that others do not have to handle the trash or come in contact with the near surfaces or objects and become contaminated. A key feature of the system is the use of an overbed table that can be repositioned around the bed and a trash bag holding device can that selectively attached at any location to the overbed's table perimeter edge. The combined benefits of a moveable overbed table and a holding device can be attached at any location to the table's edge, allows a disposable bag to be positioned within easy reach of any patient lying in the bed.

More specifically, the system includes an overbed table with a flat, elongated table top with a bag holding device selectively attached at any location to the table top's perimeter side edge. Attached to bag holding device is a disposable trash bag that sets vertically into and rests against via gravity over a support structure. Typical overbed tables have a table top that has a uniform thickness and a continuous exposed perimeter side edge. In one embodiment presented herein, the bag holding device includes two parts—a bag holding member and an intermediate member. In one embodiment, the bag holding member and intermediate member are detachable and prior to use, selectively attached to hold an opened disposable bag in a vertically configuration on the side of a table top. The intermediate member attached to the bag holding member is configured to sufficiently extend laterally from the perimeter side edge and can be selectively attach at any location to the overbed's perimeter side edge. When the bag holding device is made out of two components, the intermediate member may remain attached to the table top and the bag holding member may be selectively removed thereby enabling housekeeping personal to sanitize the bag holder and the table top surface.

In the embodiment shown herein, the bag holder member includes a rigid ring element with a center opening configured to receive a disposable trash bag closed at one end. The ring structure is circular and acts as a support surface for the upper edge of the disposable trash bag. In the embodiment shown herein, the disposable trash bag is similar to a small emesis bag with an outer plastic bag body closed at one end and with an upper cardboard ring member disposed around the bag body's top opening so the top opening remains open at all times when hung from the ring element. The cardboard ring member also provides rigidity and acts as a semi-rigid support surface for holding the bag body on the ring element.

In the embodiment shown herein, the ring element is a circular structure and the ring member is a complimentary structure that rests on top of the ring element when the bag is installed. In other embodiments, the ring element and the ring member may have other configurations that together temporarily hold the bag body in opened, vertically aligned position for filling.

In the embodiment shown herein, the intermediate member includes an upper leaf that slides over or snaps fits over the top surface of the overbed's table top, and a lower leaf that slides over or snaps fits over the bottom surface of the overbed table top. The upper and lower leaves are spring-biased to apply light forces on opposite top and bottom surfaces to hold the intermediate member over the perimeter edge of the table top. In other embodiments, the intermediate member may have other configurations that enable it to selectively attach to perimeter edge of the table top.

As mentioned above, in one embodiment, the bag holding device is made of two separate parts—a bag holding member and an intermediate member. It should be understood that the bag holding device may be one part wherein the bag holding member and the intermediate member may be integrally attached or formed together.

It should also be understood, that the system is defined as being used with an overbed table that is typically used with large beds in which patients are position for rest and medical treatment in a medical treatment facility or department, such beds as a hospital, a medical clinic, a retirement center, an outpatient surgical facility, an alcohol or drug treatment facility, a prison, or a school. It should be understood however, that other types of table top structures may be used in place of the overbed table.

During use, the overbed table may be selectively moved to different locations around the bed that accommodates the patient's position and the medical equipment around the bed. A suitable location on the perimeter edge for the intermediate member is then selected that places the disposable bag in a convenient location for the patient. The intermediate member is then attached to the perimeter edge. The bag holding element is aligned over the intermediate member so that the ring element extends outward and substantially perpendicularly from the perimeter edge. A disposable bag is then selected, unfolded and extended through the ring element's center opening. The bag is pressed downward so that the cardboard ring member is disposed over the top surface of the ring element. Discarded personal trash can then be disposed into the bag body. When the bag body is full, the entire disposable bag may be easily lifted and discarded into a larger room trash can and replaced by a new disposable bag.

DESCRIPTION OF THE PREFERRED EMBODIMENT(S)

Figure 1:
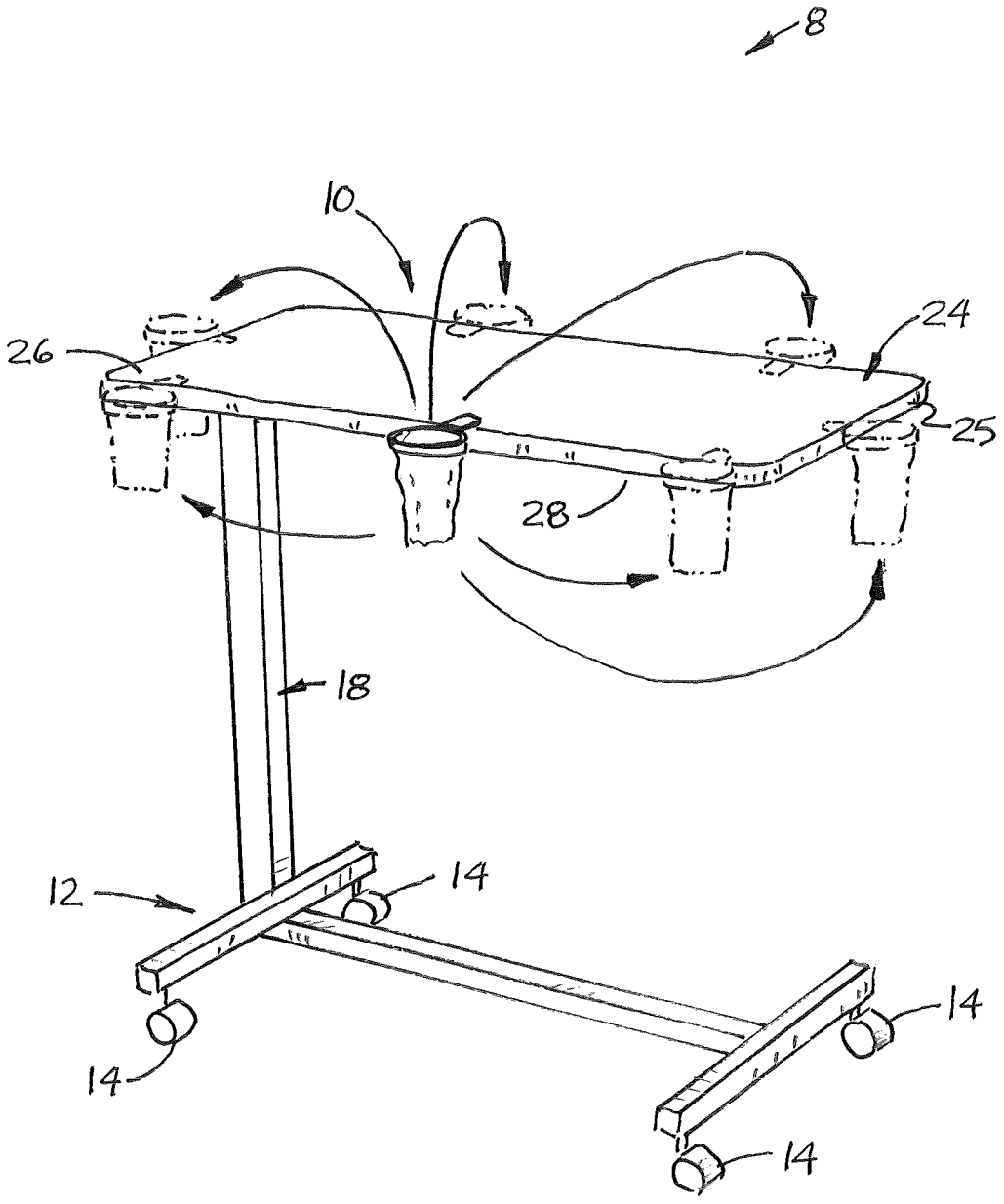
FIG. 1 is a perspective view of an overbed table trash bag holder system showing the trash bag holder being selectively attached to different locations on the overbed table's table top.
Figure 2:
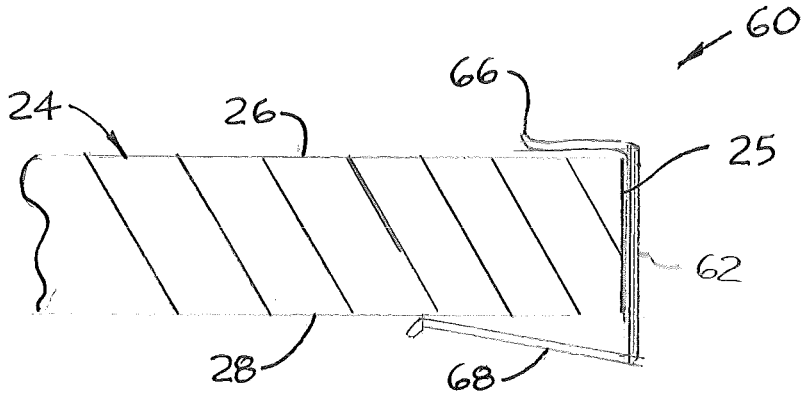
FIG. 2 is a sectional side elevational view of a table top with flat top and bottom surfaces with a U-shaped intermediate member shown attached to the table top's perimeter side edge.
Figure 3:
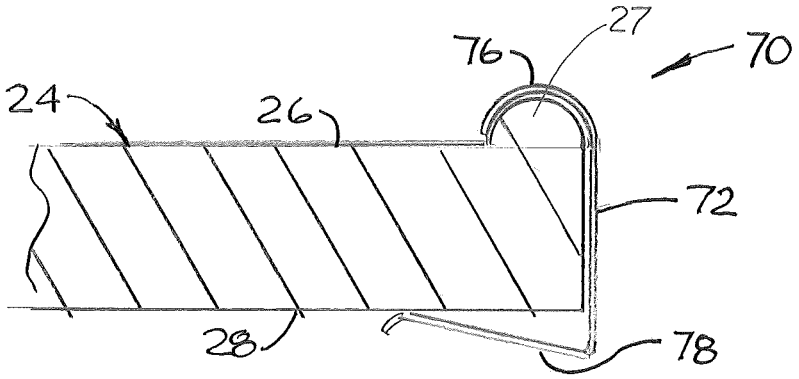
FIG. 3 is a sectional side elevational view of a table top with raised curb formed on the top surface second embodiment of the intermediate member, called a curb engaging intermediate member, shown attached to the table top's perimeter side edge.
Figure 4:
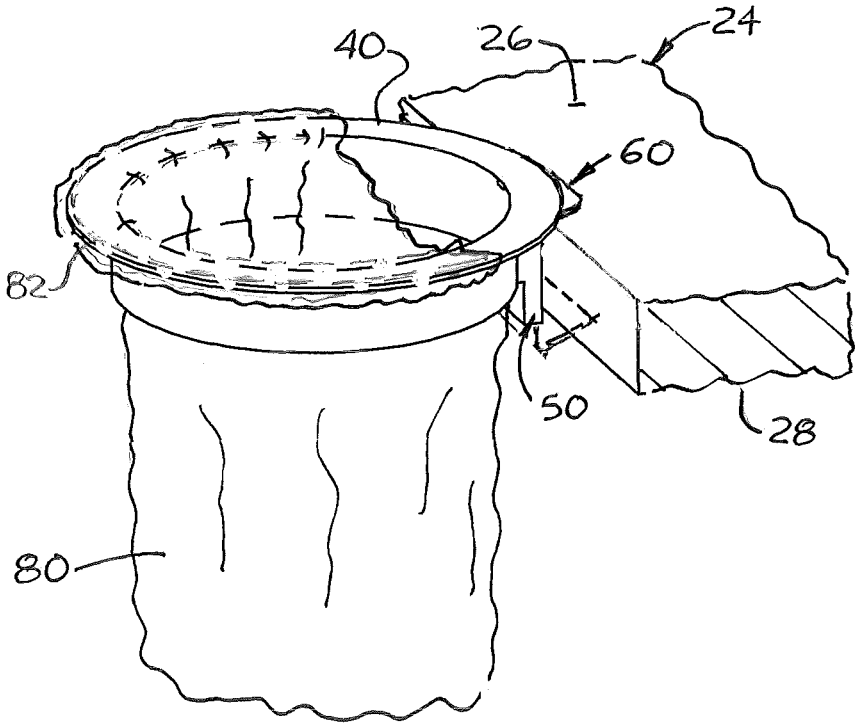
FIG. 4 is a perspective view of the trash bag holder with a U-shaped intermediate member attached to the perimeter side edge of a table top with a ring element attached to the intermediate member and a disposable bag extended into the ring element's center hole.

FIG. 1 is a perspective view of the system 8 disclosed herein that includes an overbed table 10 with an H-shaped lower base 12 mounted on caster wheels 14 that allows it to roll easily over a flat floor. Mounted on the lower base 12 is a perpendicularly aligned, vertical column 18 with a horizontally aligned elongated table top 24 mounted on the upper end of the column 18. The table top 24 includes a flat top and bottom surfaces 26, 28, respectively, and a vertical, continuous perimeter side edge 25. In one embodiment of the table top 24 (see FIGS. 1, 2, and 4), the top and bottom surfaces 26, 28 are parallel and terminate at the perimeter side edge 25. In a second embodiment, the table top 24' has a top surface 26' that includes a raised curb 27 (see FIGS. 3, and 7-9) positioned adjacent to the perimeter side edge 25'.

The system 8 includes a bag holding member 40, one of two intermediate members 60 or 70 disposed between the bag holding member 40 and the table's perimeter side edge 25, 25', respectively. In one embodiment, the bag holding member 40 includes a flat ring element 41 and a laterally extending receiving body 42. Formed inside the ring element 41 is a center opening 46 configured to receive a disposable trash bag 80.

The disposable trash bag 80 is similar to a small emesis bag with an outer plastic bag body 81 with a semi-rigid upper ring 82 disposed around its top opening. In one embodiment, the upper ring 82 is made of cardboard or paper that provides weight and mass and acts as a semi-rigid support surface for expanding and holding the bag body 81 on the top surface of the ring element 41. The bag body 81 has a volume of approximately 1 quart.

Figure 5:
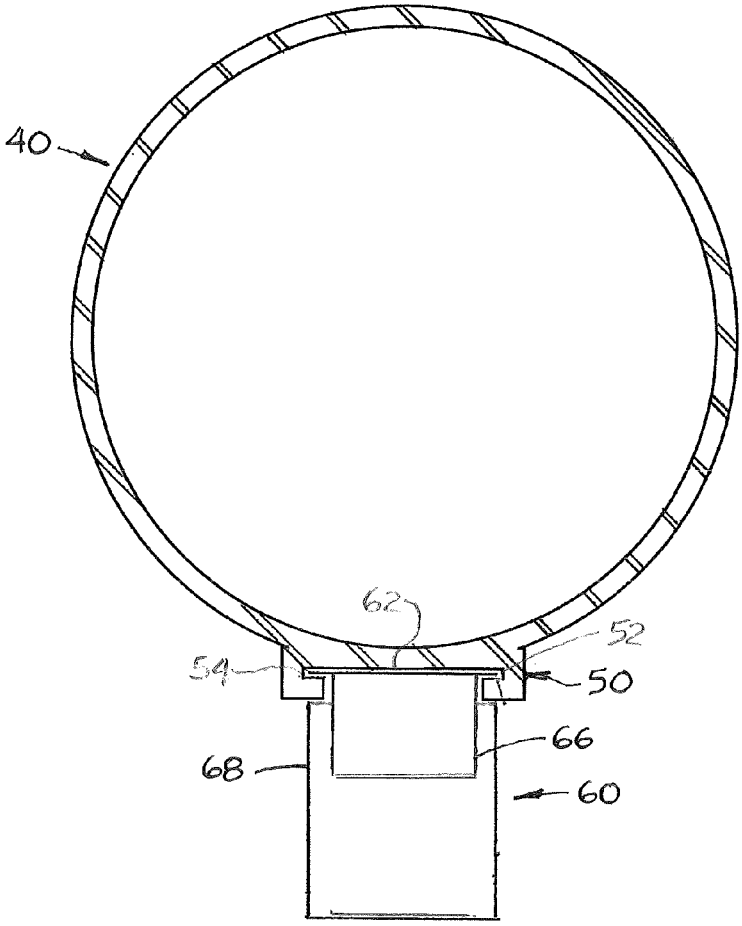
FIG. 5 is a top plan view of trash bag holder showing the bag holder with a U-shaped intermediate member attached to the ring element.

Attached or formed on the outside surface of the receiving body 42 is a receiver 50 that includes at least one slot 52 designed to receive a sleeve member 62 or 72 formed on the two intermediate members 60, 70, respectively. Both intermediate members 60, 70 include a biased perimeter edge engaging member designed to snap fit over the table top's top surface 26. The first embodiment of the intermediate member 60 shown in FIGS. 2, 5 and 6, includes two converging clamping leaves 66 and 68 separated by a vertical sleeve member 62. The length and angle of the two clamping leaves 66 and 68 are configured so that the user may easily snap fit the leaves 66, 68 over the top and bottom surfaces 26, 28, respectively, of the table top 24.

In a second embodiment, shown in FIGS. 7-11, the intermediate member 70 includes an upper curb engaging structure 76 and a lower clamping leaf 78. The curb engaging member 76 is designed to be used with a table top 24' with a continuous raised curb 27 formed on the top surface 24 adjacent to the perimeter side edge 25'. On the curb engaging structure 76, replaces the upper clamping member 62 shown used on the first intermediate member 60.

Figure 6:
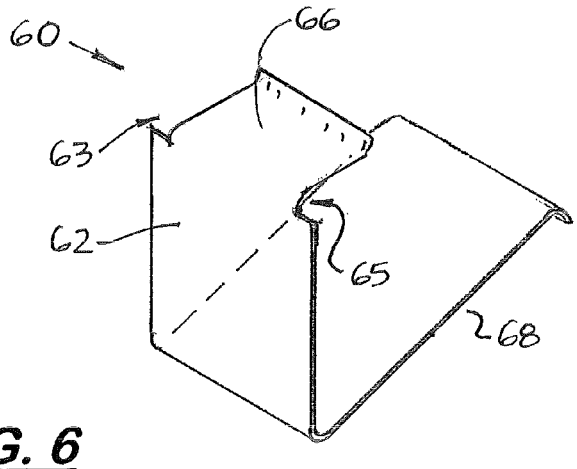
FIG. 6 is a perspective view of the U-shaped intermediate member.
Figure 7:
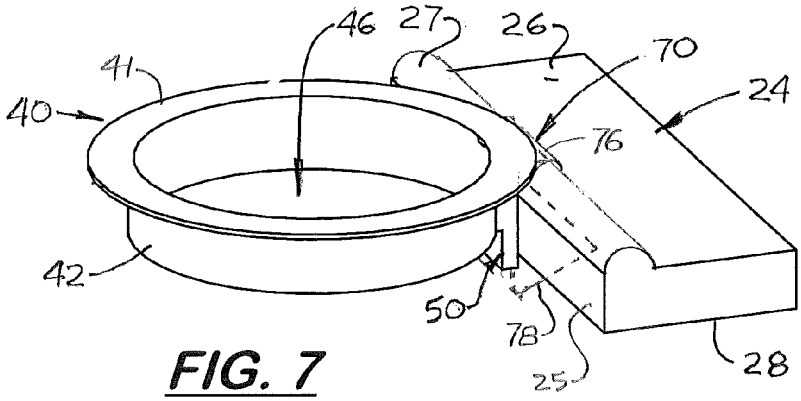
FIG. 7 is a perspective view of the second embodiment of the bag trash holder being attached to a curb style overbed table that uses a curb engaging intermediate member that snap fits around the curb.
Figure 8:
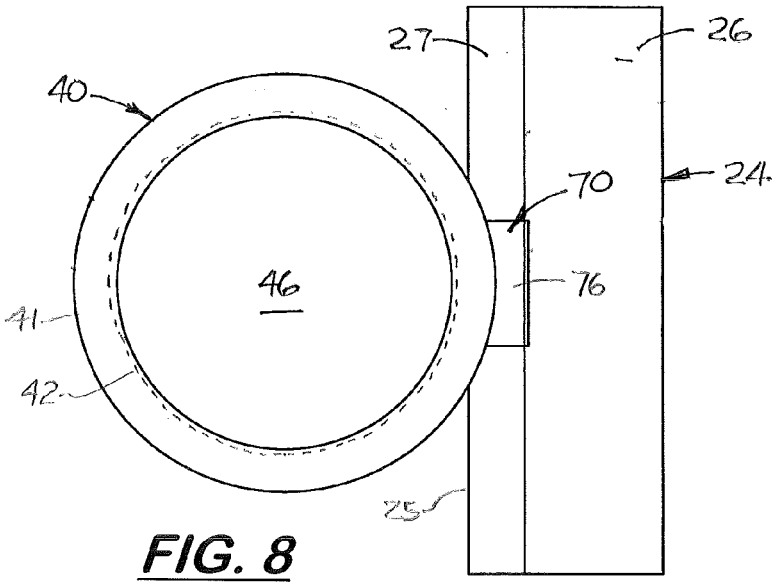
FIG. 8 is a top plan view of the second embodiment shown in FIG. 7.
Figure 9:
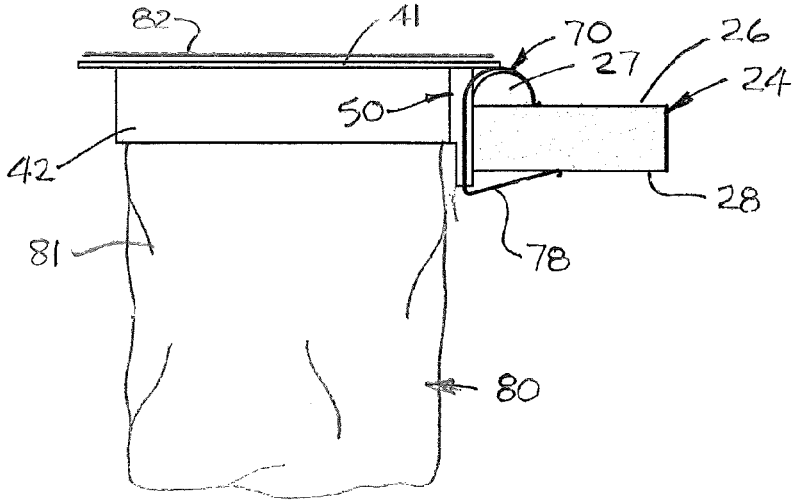
FIG. 9 is a side elevational view of the second embodiment shown in FIGS. 7 and 8.
Figure 10:
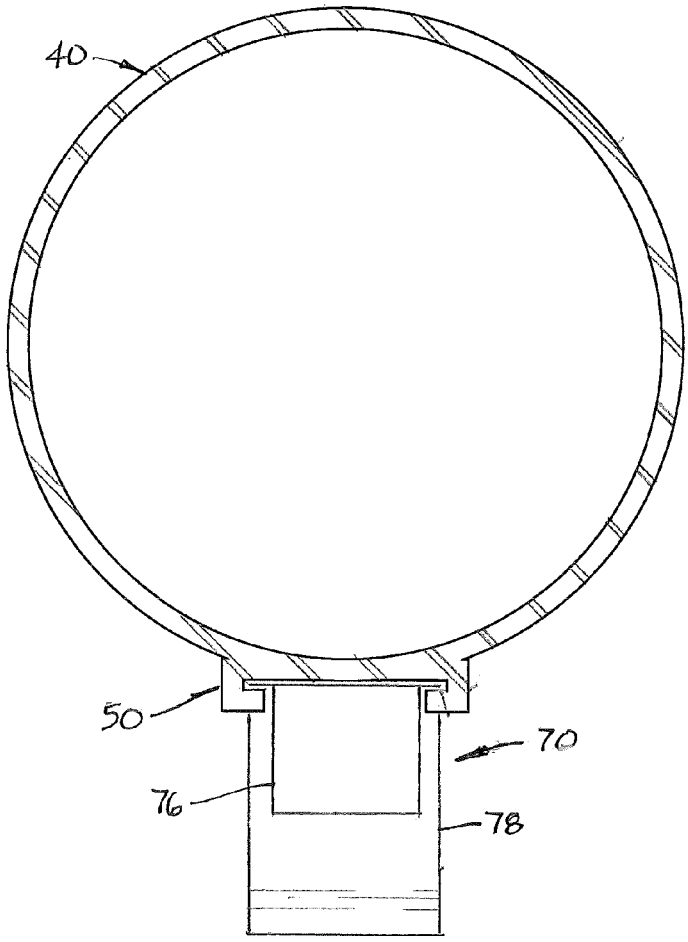
FIG. 10 is a top plan view of the second embodiment shown in FIGS. 7-9.
Figure 11:
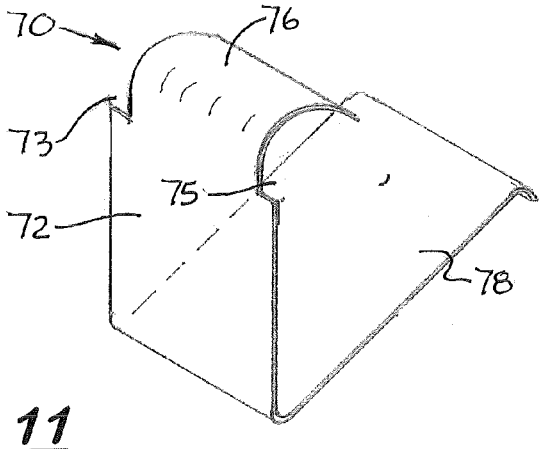
FIG. 11 is a perspective view of the curb engaging intermediate member.

As shown more clearly in FIG. 6, formed on the sleeve member 62 are two upper cutouts 63, 65 that enable the sleeve member 62 to slide into the two slots 52, 54, respectively, formed on the receiver 50. During assembly, the intermediate member 60 is tightly held within the two slots 52, 54 formed on the sleeve member 62 (see FIG. 5). When properly attached, the two clamping leaves 66, 68 press tightly against the top and bottom surfaces 25, 26, respectively, of the table top 24 and hold the sleeve member 62 in placed against the perimeter side edge 25.

During use, the overbed table 10 may be moved so that the table top 24 can be positioned at any desirable location adjacent or partially over the patient. The intermediate member 60 or 70 may be moved to any desired location on the perimeter side edge 25, 25', respectively, to accommodate the table top's new location relative to the patient.

Operation of the Invention

An overbed table 10 is first selected and positioned at a desired location over the bed that accommodates the needs of the patient and the healthcare worker. A bag holding member 40 with a suitable intermediate member 60 and 70 configured to engage the perimeter side edge 25, 25' of the table top 24, 24', respectively, is then selected. A suitable location on the perimeter edge 25, 25' for the bag holding member 40 is then selected so that trash may be easily placed into the trash bag 80 when attached thereto. The intermediate member 60 or 70 is then attached to the perimeter side edge 25, 25' on the overbed table 10. The upper and lower leaves 66, 68 and 76, 78 on the intermediate member 60 and 70, respectively, are pulled apart and pressed onto the perimeter side edge 25, 25', respectively. The slots 52 and 54 on the receiver 50 are then aligned over the vertical sleeve member 62, 72 and the receiver 50 is then forced downward to engage the intermediate member 60, 70, respectively. Alternatively, the intermediate member 60 or 70 may be attached to the sleeve member 62, 72 prior to attaching the intermediate member 60 or 70 to the perimeter side edge 25, 25'.

The disposable trash bag 80 is then selected, unfolded, and inserted into the center hole 46 formed in the ring element 41. The disposable bag's outer bag body 81 extends through the center opening 46 and the upper ring 82 is disposed over and positioned against the top surface of the upper flat ring element 41. Trash may then be disposed into the bag body 81. When full, the trash bag 80 expands and hangs downward from the upper ring element 41. The full trash bag 80 may be removed and discarded from the ring element 41 and replaced with a new trash bag 80. When the location of the disposable trash bag 80 is changed or when the table top 24, 24' needs to be cleaned with a suitable disinfectant, the intermediate members 60 and 70 are detached from the perimeter side edge 25, 25'.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A repositionable, disposable trash bag system for a patient lying in a bed, the system comprises:

a. an overbed table with a lower base, a vertical column, and an elongated table top with a perimeter side edge, the lower base and the vertical column and the table top being configured so the overbed table may be moved to different locations around a bed with the table top extended over a bed on which a patient is laying;

b. a bag holding member selectively connected to the perimeter side edge, the bag holding member includes a ring element with a center opening; and, c. a disposable trash bag inserted and extended downward into the center opening and supported by the ring element when filled with trash.

2. The disposable trash bag system as recited in claim 1, wherein the ring element is connected to an intermediate member that press against and slides onto the table top.

3. The disposable trash bag system as recited in claim 2, wherein said intermediate member includes an upper leaf and a lower leaf configured to apply a gripping force on opposite sides of the table top.

4. The disposable trash bag system as recited in claim 3, wherein the bag holding device member and the intermediate member are detachable and selectively connected together when used.

5. The disposable trash bag system as recited in claim 2, wherein the bag holding member and the intermediate member are selectively connected together.

6. The disposable trash bag system as recited in claim 1, further including the disposable trash bag with a top opening and a upper ring member surrounding the top opening, the ring member configured to rest on top of the ring element when the disposable trash bag is placed into the center opening thereby holding and supporting the disposable trash bag.

7. The disposable trash bag system as recited in claim 1, further including a raised curb formed on the top surface of the table top and adjacent to the perimeter side edge.

8. The disposable trash bag system as recited in claim 7, wherein the ring element is connected to an intermediate member and configured to press against the perimeter side edge and that slides onto the table top and engages the raised curb.

9. The disposable trash bag system as recited in claim 8, wherein said intermediate member includes an upper leaf and a lower leaf configured to apply a gripping force on opposite sides of the table top.

10. A system to prevent the spread of infection from and to patients lying in a bed in a medical treatment room, comprising;

a. an overbed table with a flat table top with a perimeter side edge, the overbed table configured to be moved to different locations on side of a bed where a patient is position so the table top may extend over the bed and used to support objects in a convenient located for the patient;

b. a bag holding device member that extends laterally from the perimeter side edge of the table top, the bag holding member includes means for selectively attaching to the table top and extending laterally there from and means for holding a disposable trash bag in a vertical alignment adjacent to the perimeter side edge; and, c. a disposable trash bag attached to the means for holding a disposable trash bag.

11. The system as recited in claim 10, wherein the means for selectively attaching to the table top is an intermediate member that includes an upper leaf and a lower leaf configured to apply a gripping force on opposite sides of the table top.

12. The system as recited in claim 11, wherein the means for holding a disposable trash bag is a ring element and a ring member on the disposable trash bag that rests onto of the ring element to hold and support the bag in a vertical alignment for filling with trash.

13. The disposable trash bag system as recited in claim 10, wherein the intermediate member includes a curb engaging structure configured to engage a raise curb formed on the top table adjacent to the perimeter side edge.

14. The system as recited in claim 10, wherein the means for holding a disposable trash bag a ring element on the bag holding member and a ring member on the disposable trash bag, the ring element and the ring member being configured to that when the disposable trash is inserted into the ring element, the ring member is positioned over the ring element and holds and supports the bag in a vertical alignment on the bag holding member for filling with trash.

15. A method for preventing the contaminating of infections caused by disposable of personal trash generated by a patient in a bed, comprising the following steps:

a. positioning an overbed table with an elongated, horizontal table top and an exposed perimeter side edge adjacent to the bed so the table top may be used by the patient laying on a bed;

b. selecting a disposable trash bag holder that includes a bag holding member configured to be selectively attached to different locations of the perimeter side edge of the overbed table, the bag holding member also includes a ring element with a center opening that extends laterally from the perimeter edge of the table top that receives and holds a disposable trash bag;

c. attaching the trash bag holder to the perimeter side edge of the table top;

d. placing a disposable trash bag through the center opening on the ring element; and, e. disposing trash into the disposable trash bag and discarding the disposable trash bag when full of trash.

* * * * *